US006609374B2

(12) United States Patent
Feucht et al.

(10) Patent No.: US 6,609,374 B2
(45) Date of Patent: Aug. 26, 2003

(54) BYPASS VENTURI ASSEMBLY FOR AN EXHAUST GAS RECIRCULATION SYSTEM

(75) Inventors: Dennis D. Feucht, Morton, IL (US); Paul F. Olsen, Denton, TX (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/027,037

(22) Filed: Dec. 20, 2001

(65) Prior Publication Data

US 2003/0115871 A1 Jun. 26, 2003

Related U.S. Application Data

(63) Continuation-in-part of application No. 10/025,368, filed on Dec. 19, 2001, now Pat. No. 6,439,212.

(51) Int. Cl.[7] ..... F02B 33/44; F02B 47/08; F02M 25/07

(52) U.S. Cl. ..... 60/602; 60/605.1; 60/605.2; 123/568.17; 123/568.18; 137/888

(58) Field of Search ..... 60/602, 605.1, 60/605.2; 123/568.11, 568.12, 568.17, 568.18; 137/888, 601.17

(56) References Cited

U.S. PATENT DOCUMENTS 5,802,846 A 9/1998 Bailey
6,267,106 B1 * 7/2001 Feucht ..... 123/568.17
6,343,594 B1 * 2/2002 Koeslin et al. ..... 123/568.17
6,408,833 B1 * 6/2002 Faletti ..... 123/568.17
6,439,212 B1 * 8/2002 Coleman et al. ..... 123/568.17
6,453,926 B1 * 9/2002 Baker ..... 137/888

* cited by examiner

*Primary Examiner*—Sheldon J. Richter
(74) *Attorney, Agent, or Firm*—Todd T Taylor

(57) ABSTRACT

An internal combustion engine, particularly suitable for use in a motor vehicle, is provided with a combustion air supply, an exhaust manifold, and a bypass venturi assembly. The bypass venturi assembly includes a housing having an outlet, a combustion air inlet connected and in communication with the combustion air supply, and an exhaust gas inlet connected and in communication with the exhaust manifold. A venturi nozzle is positioned in communication with the combustion air inlet. The venturi nozzle defines a bypass venturi section therein. The venturi nozzle and the housing define an exhaust gas venturi section therebetween terminating at an induction area. The venturi nozzle has a plurality of through holes in communication with a downstream portion of the exhaust gas venturi section. The exhaust gas inlet terminates at the induction area. A bypass valve is positioned to open and close the bypass venturi section. The bypass venturi assembly has a compact design with simple and efficient operation for selectively controlling the amount of exhaust gas which is inducted into the compressed combustion air.

21 Claims, 4 Drawing Sheets

BYPASS VENTURI ASSEMBLY FOR AN EXHAUST GAS RECIRCULATION SYSTEM

CROSS-REFERENCE TO RELATED APPLICATION

The present application is a continuation-in-part of U.S. Ser. No. 10/025,368, filed Dec. 19, 2001, entitled "BYPASS VENTURI ASSEMBLY AND ELBOW WITH TURNING VANE FOR AN EXHAUST GAS RECIRCULATION SYSTEM", now U.S. Pat. No. 6,439,212.

TECHNICAL FIELD

The present invention relates to exhaust gas recirculation systems in an internal combustion engine, and, more particularly, to an induction venturi in such exhaust gas recirculation systems.

BACKGROUND

An exhaust gas recirculation (EGR) system is used for controlling the generation of undesirable pollutant gases and particulate matter in the operation of internal combustion engines. Such systems have proven particularly useful in internal combustion engines used in motor vehicles such as passenger cars, light duty trucks, and other on-road motor equipment. EGR systems primarily recirculate the exhaust gas by-products into the intake air supply of the internal combustion engine. The exhaust gas which is reintroduced to the engine cylinder reduces the concentration of oxygen therein, which in turn lowers the maximum combustion temperature within the cylinder and slows the chemical reaction of the combustion process, decreasing the formation of nitrous oxides (NoX). Furthermore, the exhaust gases typically contain unburned hydrocarbons which are burned on reintroduction into the engine cylinder, which further reduces the emission of exhaust gas by-products which would be emitted as undesirable pollutants from the internal combustion engine.

When utilizing EGR in a turbocharged diesel engine, the exhaust gas to be recirculated is preferably removed upstream of the exhaust gas driven turbine associated with the turbocharger. In many EGR applications, the exhaust gas is diverted directly from the exhaust manifold. Likewise, the recirculated exhaust gas is preferably reintroduced to the intake air stream downstream of the compressor and air-to-air aftercooler (ATAAC). Reintroducing the exhaust gas downstream of the compressor and ATAAC is preferred due to the reliability and maintainability concerns that arise if the exhaust gas passes through the compressor and ATAAC. An example of such an EGR system is disclosed in U.S. Pat. No. 5,802,846 (Bailey), which is assigned to the assignee of the present invention.

With conventional EGR systems as described above, the charged and cooled combustion air which is transported from the ATAAC is at a relatively high pressure as a result of the charging from the turbocharger. Since the exhaust gas is also typically inducted into the combustion air flow downstream of the ATAAC, conventional EGR systems are configured to allow the lower pressure exhaust gas to mix with the higher pressure combustion air. Such EGR systems may include a venturi section which induces the flow of exhaust gas into the flow of combustion air passing therethrough. An efficient venturi section is designed to "pump" exhaust gas from a lower pressure exhaust manifold to a higher pressure intake manifold. However, because varying EGR rates are required throughout the engine speed and load range, a variable orifice venturi may be preferred. Such a variable orifice venturi is physically difficult and complex to design and manufacture. Accordingly, venturi systems including a fixed orifice venturi and a combustion air bypass circuit are favored. The bypass circuit consists of piping and a butterfly valve in a combustion air flow path. The butterfly valve is controllably actuated using an electronic controller which senses various parameters associated with operation of the engine.

With a venturi section as described above, the maximum flow velocity and minimum pressure of the combustion air flowing through the venturi section occurs within the venturi throat disposed upstream from the expansion section. The butterfly valve is used to control the flow of combustion air to the venturi throat, which in turn affects the flow velocity and vacuum pressure created therein. By varying the vacuum pressure, the amount of exhaust gas which is induced into the venturi throat of the venturi section can be varied. However, inducing the exhaust gas into the flow of combustion air in the venturi throat may affect the diffusion and pressure recovery of the mixture within the expansion section of the venturi.

The present invention is directed to overcoming one or more of the problems as set forth above.

SUMMARY OF THE INVENTION

In one aspect of the invention, an internal combustion engine is provided with a combustion air supply, an exhaust manifold, and a bypass venturi assembly. The bypass venturi assembly includes a housing having an outlet, a combustion air inlet connected and in communication with the combustion air supply, and an exhaust gas inlet connected and in communication with the exhaust manifold. A venturi nozzle is positioned in communication with the combustion air inlet. The venturi nozzle defines a bypass venturi section therein. The venturi nozzle and the housing define an exhaust gas venturi section therebetween terminating at an induction area. The venturi nozzle has a plurality of through holes in communication with a downstream portion of the exhaust gas venturi section. The exhaust gas inlet terminates at the induction area. A bypass valve is positioned to open and close the bypass venturi section.

In another aspect of the invention, a method of recirculating exhaust gas in an internal combustion engine is provided with the steps of: providing a bypass venturi assembly including a housing having a combustion air inlet, an exhaust gas inlet and an outlet, a venturi nozzle in communication with the combustion air inlet, the venturi nozzle defining a bypass venturi section therein, the venturi nozzle and the housing defining an exhaust gas venturi section therebetween terminating at an induction area, the venturi nozzle having a plurality of through holes in communication with a downstream portion of the exhaust gas venturi section; transporting combustion air to the combustion air inlet; transporting exhaust gas to the exhaust gas inlet and the induction area; and selectively operating a bypass valve to open and close the bypass venturi section and thereby control an amount of exhaust gas inducted at the induction area.

DETAILED DESCRIPTION

Figure 1:
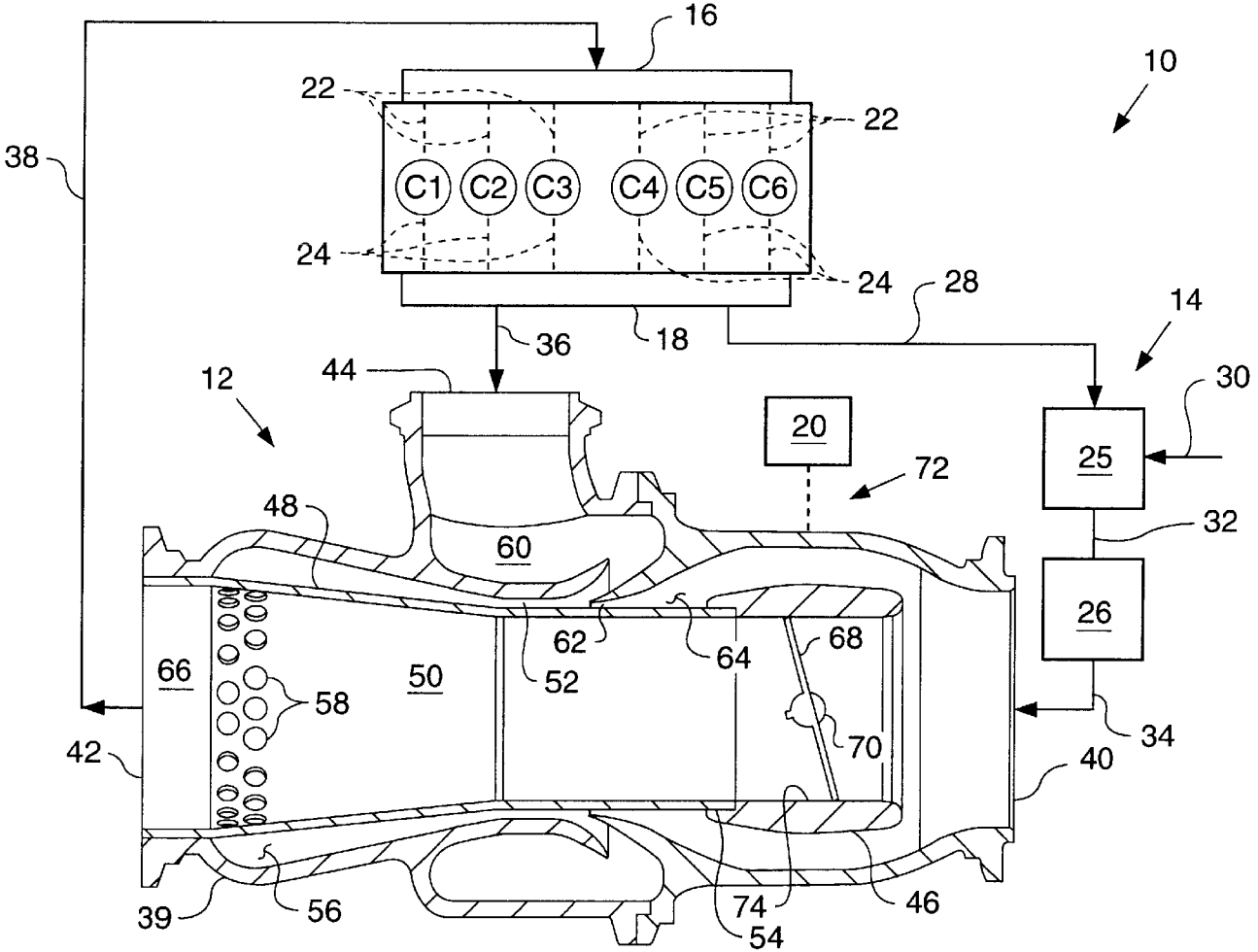
FIG. 1 illustrates an internal combustion engine including an embodiment of a bypass venturi assembly of the present invention.

Referring now to the drawings, and more particularly to FIG. 1, there is shown an embodiment of an internal combustion engine 10, including an embodiment of a bypass venturi assembly 12 of the present invention. Internal combustion engine 10 also includes a combustion air supply 14, intake manifold 16, exhaust manifold 18 and engine control module (ECM) 20.

Intake manifold 16 and exhaust manifold 18 are each fluidly coupled with a plurality of combustion cylinders C1 through C6, as indicated schematically by dashed lines 22 and 24, respectively. In the embodiment shown, a single intake manifold 16 and exhaust manifold 18 are fluidly coupled with combustion cylinders C1 through C6. However, it is also possible to configure intake manifold 16 and/or exhaust manifold 18 as a split or multiple-piece manifold, each associated with a different group of combustion cylinders.

Combustion air supply 14 provides a source of pressurized combustion air to bypass venturi assembly 12, and ultimately to intake manifold 16. Combustion air supply 14 includes a turbocharger 25 and an ATAAC 26, each of which are shown schematically in FIG. 1 for simplicity. Turbocharger 25 includes a turbine and a compressor (not shown) therein. The turbine, in known manner, is driven by exhaust gas received from exhaust manifold 18 via fluid line 28. The turbine is mechanically coupled with the compressor, which receives ambient combustion air as indicated by arrow 30. The compressor compresses the ambient combustion air and outputs compressed combustion air via fluid line 32. The compressed combustion air is at an elevated temperature as a result of the work which is performed thereon during the compression process within turbocharger 25. The hot combustion air is then cooled within ATAAC 26.

Figure 2:
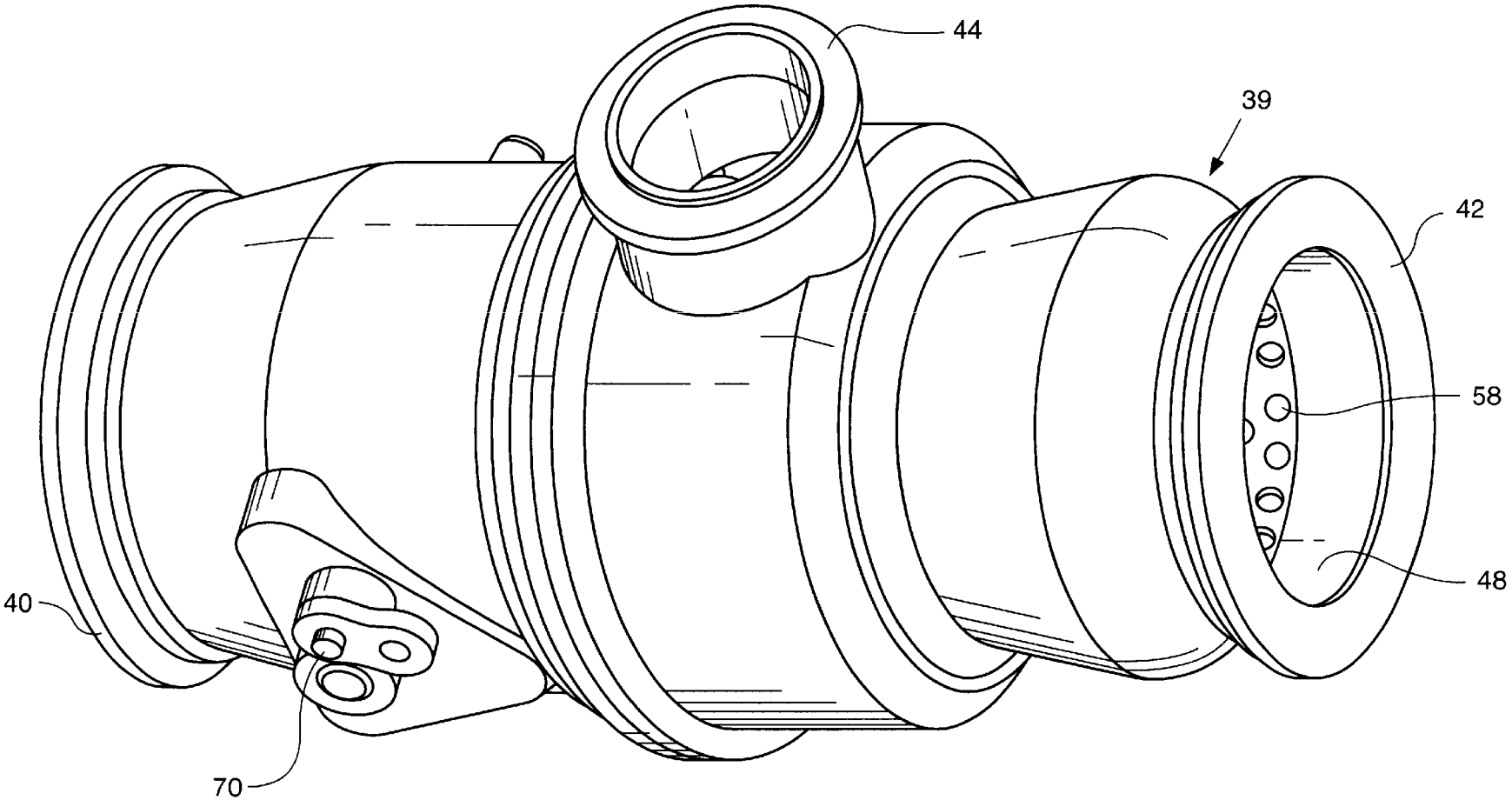
FIG. 2 is a perspective view of the bypass venturi assembly shown in FIG. 1.

Bypass venturi assembly 12 (FIGS. 1 and 2) receives cooled and compressed combustion air via line 34, and also receives exhaust gas via line 36. The exhaust gas line 36 may also include an exhaust gas cooler therein (not shown). Bypass venturi assembly 12 controllably mixes a selected amount of exhaust gas with the cooled and compressed combustion air and outputs the air/exhaust gas mixture to line 38. More particularly, bypass venturi assembly 12 includes a housing 39 having a combustion air inlet 40, an outlet 42 and an exhaust gas inlet 44. Housing 39, in the embodiment shown, is constructed as a two-part housing for manufacturing purposes. However, as an alternative the housing could be a single piece or be made of more than two pieces. Combustion air inlet 40 is connected and in communication with combustion air supply 14 via line 34. Exhaust gas inlet 44 is connected and in communication with exhaust manifold 18 via line 36. Outlet 42 is connected and in communication with intake manifold 16 via line 38.

Figure 3:
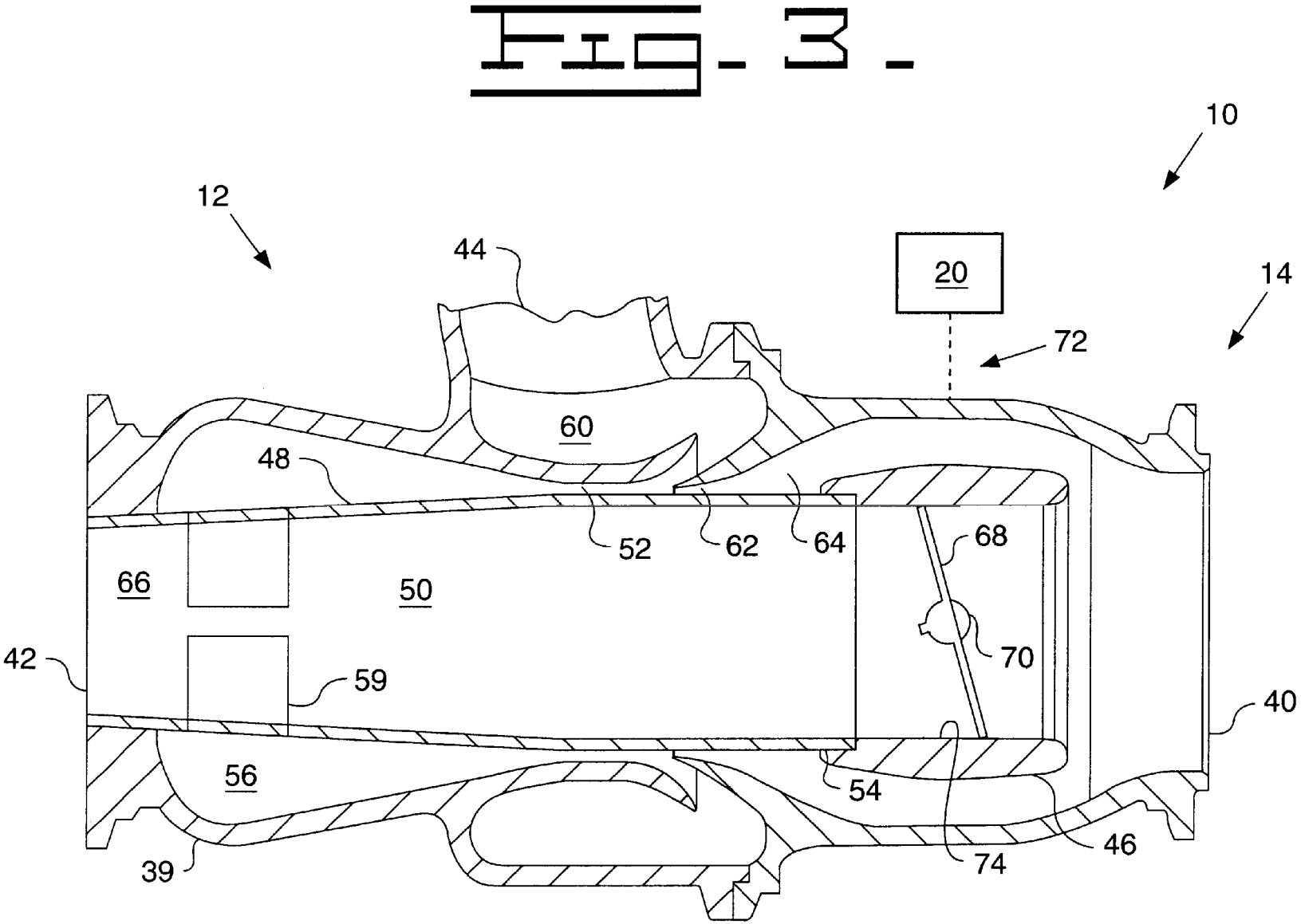
FIG. 3 is a perspective view of the bypass venturi assembly shown in FIG. 1 having an alternative nozzle.
Figure 4:
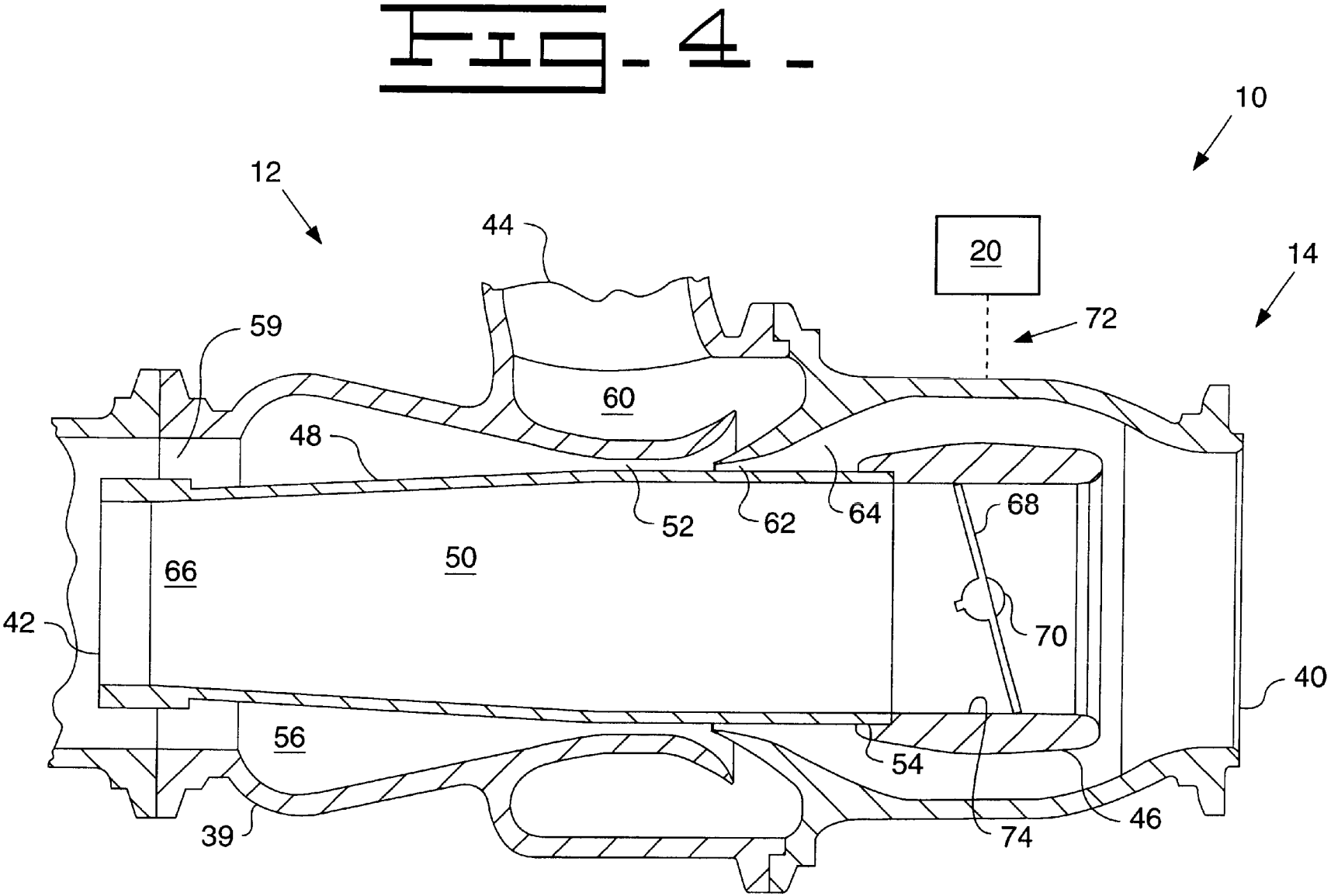
FIG. 4 is a perspective view of the bypass venturi assembly shown in FIG. 1 having an alternative nozzle.

Bypass venturi assembly 12 includes a center section 46 positioned within housing 39. Center section 46 is positioned adjacent to and in communication with combustion air inlet 40. A nozzle 48 is also positioned within housing 39. The nozzle 48 as shown in FIG. 1 is an expanding area nozzle but as shown in FIGS. 3 and 4 may be made as a straight section. Center section 46 is formed with an annular recess 54 which faces toward and receives an end of nozzle 48. Center section 46 and nozzle 48 conjunctively define a bypass venturi section 50 therein which terminates at outlet 42.

Exhaust gas venturi section 64 includes a venturi throat portion 62 and tapers to and terminates at an induction area 60 being downstream of the venturi throat, at which exhaust gas is inducted into the passing flow of compressed combustion air traveling at an increased velocity and decreased pressure through induction area 60. Dependent upon the pressure and velocity of the compressed combustion air, the amount of exhaust gas which is inducted at induction area 60 may be controllably varied. Induction area 60 is generally annular shaped around the periphery of venturi throat portion 62.

Housing 39 and nozzle 48 also define an annular receiver section 52 therebetween which is positioned immediately downstream from and adjacent to induction area 60. Annular receiver section 52 has a cross sectional area which remains substantially constant for a predetermined distance in the direction of fluid flow to assist in uniformly mixing the inducted exhaust gas into the flow of combustion air.

Housing 39 and nozzle 48 further define a pressure recovery section 56 therebetween immediately downstream from and adjacent to annular receiver section 52. Housing 39 diverges away from venturi nozzle 48 in a direction of fluid flow such that pressure recovery section 56 has an increasing cross-sectional area in the direction of fluid flow. The expanding cross-sectional area causes the pressure of the combustion air/exhaust gas mixture to increase after flowing from annular receiver section 52. The cross-sectional area increases in the direction of fluid flow between housing 39 and nozzle 48.

Nozzle 48 includes a plurality of radially extending through holes 58 which fluidly interconnect bypass venturi section 50 with pressure recovery section 56. The mixed exhaust and air from pressure recovery section 56 is shunted into the bypass air in bypass venturi section 50. Mixing of the two fluid streams occurs in mixer section 66. It should be acknowledged that the reintroduction geometry could be slots or open windows 59 as is shown in FIGS. 3 and 4 respectively as well as the holes shown in FIG. 1.

Mixer section 66 within housing 39 is positioned downstream from pressure recovery section 56. Mixer section 66 mixes the combustion air/exhaust gas mixture transported through pressure recovery section 56 with the combustion air transported through bypass venturi section 50.

A bypass valve 68 is positioned within center section 46 and is controllably actuated to open and close bypass venturi section 50. In the embodiment shown, bypass valve 68 is in the form of a butterfly valve which is carried by a pivotable shaft 70. Shaft 70 is controllably actuated by ECM 20, as indicated by phantom line 72, which in turn selectively opens and closes butterfly valve 68 to control an amount of combustion air which flows through bypass venturi section 50. Through bore 74 within center section 46 is substantially cylindrical shaped with an inside diameter which is slightly smaller than the diameter of venturi throat 62. The particular configuration of through bore 74 may of course vary, depending upon the application.

ECM 20 controllably actuates bypass valve 68 using selected input parameters received from sensor signals, such as engine load, intake manifold pressure, engine temperature, etc. ECM 20 may be configured to carry out the control logic using software, hardware and/or firmware, depending upon the particular application.

INDUSTRIAL APPLICABILITY

During use, combustion occurs within combustion cylinders C1 through C6 which produces exhaust gas received within exhaust manifold 18. Exhaust gas is transported to turbocharger 25 via fluid line 28 for rotatably driving the turbine within turbocharger 25. The turbine rotatably drives the compressor, which in turn compresses combustion air and outputs compressed combustion air via line 32. The hot, compressed combustion air is cooled within ATAAC 26 and transported via line 34 to combustion air inlet 40 of bypass venturi assembly 12. ECM 20 controllably actuates butterfly valve 68 to control the amount of compressed combustion air which bypasses through bypass venturi section 50 within center section 46 and nozzle 48. Compressed combustion air also flows through exhaust gas venturi section 64 to venturi throat portion 62. As the combustion air flows through exhaust gas venturi section 64, the velocity thereof increases and the pressure decreases. Exhaust gas is also received from exhaust manifold 18 at exhaust gas inlet 44 via fluid line 36. Dependent upon the pressure and velocity of the combustion air which flows past venturi throat portion 62, the amount of exhaust gas which is inducted into the passing flow of combustion air at induction area 60 is varied. The combustion air and exhaust gas mixture flow through annular receiver section 52 and expand within pressure recovery section 56 immediately downstream thereof. The pressure of the combustion air/exhaust gas mixture increases and the velocity decreases within pressure recovery section 56. The compressed combustion air which flows past butterfly bypass valve 68 and the combustion air/exhaust gas mixture which flows from pressure recovery section 56 mix together within mixer section 66 adjacent outlet 42. The combustion air/exhaust gas mixture is then transported from outlet 42 to intake manifold 16 via line 38. By varying the position of bypass valve 68 within center section 46 using ECM 20 based upon various operating parameters, the amount of exhaust gas which is inducted into the combustion air may likewise be varied.

Bypass venturi assembly 12 of the present invention allows exhaust gas to be effectively and controllably inducted into a pressurized flow of combustion air using a venturi assembly having a minimized overall length. The reduced overall size of bypass venturi assembly 12 allows it to be positioned within the tight geometric constraints of an engine compartment in a motor vehicle. The bypass venturi assembly may either be carried by the frame of the vehicle, engine block, cylinder head or other suitable mounting location within the engine compartment. By utilizing a bypass valve positioned in association with the venturi nozzle, the pressure differential relative to the pressure of the exhaust gas within the exhaust manifold may be varied, and thus the amount of exhaust gas which is inducted into the combustion air may likewise be effectively varied. Thus, the bypass venturi assembly provides a compact design with simple and efficient operation.

Other aspects, objects and advantages of this invention can be obtained from a study of the drawings, the disclosure and the appended claims.

What is claimed is:

1. An internal combustion engine, comprising:

a combustion air supply;

an exhaust manifold;

a bypass venturi assembly including a housing having an outlet, a combustion air inlet connected and in communication with said combustion air supply, and an exhaust gas inlet connected and in communication with said exhaust manifold, and a venturi nozzle in communication with said combustion air inlet, said venturi nozzle defining a bypass venturi section therein, said venturi nozzle and said housing defining an exhaust gas venturi section therebetween terminating at an induction area, said venturi nozzle having a plurality of through holes in communication with a downstream portion of said exhaust gas venturi section, said exhaust gas inlet terminating at said induction area, and a bypass valve positioned to open and close said bypass venturi section.

2. The internal combustion engine of claim 1, including an annular receiver section between said venturi nozzle and said housing immediately downstream from and adjacent to said induction area.

3. The internal combustion engine of claim 2, said annular receiver section having a substantially constant cross-sectional area.

4. The internal combustion engine of claim 2, including a pressure recovery section between said venturi nozzle and said housing immediately downstream from and adjacent to said annular receiver section, said pressure recovery section having an increasing cross-sectional area in a direction extending away from said annular receiver section.

5. The internal combustion engine of claim 4, including a mixer section within said housing downstream from each of said pressure recovery section and said bypass venturi section.

6. The internal combustion engine of claim 1, including an engine control module controllably coupled with said bypass valve.

7. The internal combustion engine of claim 6, said bypass valve being a butterfly valve.

8. The internal combustion engine of claim 1, including a center section within said housing, said bypass valve terminating at said center section, said center section having a through bore, said bypass valve disposed within said through bore.

9. The internal combustion engine of claim 8, said pressure recovery section being at least in part between said center section and said housing.

10. The internal combustion engine of claim 1, said combustion air supply including a turbocharger.

11. The internal combustion engine of claim 10, said combustion air supply including an air-to-air-aftercooler coupled between said turbocharger and said bypass venturi assembly.

12. A venturi assembly for recirculating exhaust gas in an internal combustion engine, comprising:

a housing having an outlet, a combustion air inlet and an exhaust gas inlet;

a venturi nozzle in communication with said combustion air inlet, said venturi nozzle defining a bypass venturi section therein, said venturi nozzle and said housing defining a venturi section therebetween terminating at an induction area, said venturi nozzle having a plurality of through holes in communication with a downstream portion of said exhaust gas venturi section, said induction area adjacent said exhaust gas inlet; and a bypass valve positioned to open and close said bypass venturi section.

13. The venturi assembly of claim 12, including an annular receiver section between said venturi nozzle and said housing immediately downstream from and adjacent to said induction area.

14. The venturi assembly of claim 13, said annular receiver section having a substantially constant cross-sectional area.

15. The venturi assembly of claim 13, including a pressure recovery section between said venturi nozzle and said housing immediately downstream from and adjacent to said annular receiver section, said pressure recovery section having an increasing cross-sectional area in a direction extending away from said annular receiver section.

16. The venturi assembly of claim 15, including a mixer section within said housing downstream from each of said pressure recovery section and said bypass venturi section.

17. The venturi assembly of claim 12, including a center section within said housing, said bypass valve terminating at said center section, said center section having a through bore, said bypass valve disposed within said through bore.

18. The venturi assembly of claim 17, said pressure recovery section being in part between said center section and said housing.

19. A method of recirculating exhaust gas in an internal combustion engine, comprising the steps of:

providing a bypass venturi assembly including a housing having a combustion air inlet, an exhaust gas inlet and an outlet, a venturi nozzle in communication with said combustion air inlet, said venturi nozzle defining a bypass venturi section therein, said venturi nozzle and said housing defining an exhaust gas venturi section therebetween terminating at an induction area, said venturi nozzle having a plurality of through holes in communication with a downstream portion of said exhaust gas venturi section;

transporting combustion air to said combustion air inlet;

transporting exhaust gas to said exhaust gas inlet and said induction area; and selectively operating a bypass valve to open and close said bypass venturi section and thereby control an amount of exhaust gas inducted at said induction area.

20. The method of claim 19, including the step of increasing a pressure of the inducted exhaust gas within a pressure recovery section between said venturi nozzle and said housing immediately downstream from and adjacent to said annular receiver section.

21. The method of claim 20, including the step of mixing said exhaust gas with combustion air in a mixer section within said housing downstream from each of said pressure recovery section and said bypass venturi section.

* * * * *